US006161348A

United States Patent [19]

Morris

[11] Patent Number: 6,161,348

[45] Date of Patent: Dec. 19, 2000

[54] DROP-OUT FIRE VENT

[75] Inventor: Richard P. Morris, Mississauga, Canada

[73] Assignee: C/S Construction Specialties Limited, Mississauga, Canada

[21] Appl. No.: 09/276,508

[22] Filed: Mar. 25, 1999

[51] Int. Cl.[7] ..... E04C 2/00

[52] U.S. Cl. ..... 52/232; 52/1; 52/200; 52/72; 49/1; 49/7; 49/8

[58] Field of Search ..... 52/1, 232, 200, 52/72; 49/7, 8, 1

[56] References Cited

U.S. PATENT DOCUMENTS 3,731,442 5/1973 Kiyoshi ..... 52/232
3,788,013 1/1974 Veen, Jr. ..... 52/1
3,918,226 11/1975 Naidus .
4,080,763 3/1978 Naidus et al. .

*Primary Examiner*—Carl D. Friedman
*Assistant Examiner*—Christy Syres
*Attorney, Agent, or Firm*—Bereskin & Parr

[57] ABSTRACT

A drop-out fire vent for a building has a plastic dome that softens and loses structural integrity with increasing temperature. However, the dome is prevented from dropping out by an internal trap door controlled by a fusible link that will release at a precise temperature. This allows the vent to be used in combination with sprinkler systems such as ESFR systems that require opening of the vent at a precise temperature after the sprinklers have been triggered.

12 Claims, 7 Drawing Sheets

DROP-OUT FIRE VENT

FIELD OF THE INVENTION

This invention relates to so-called drop-out fire vents for buildings.

BACKGROUND OF THE INVENTION

Drop-out fire vents are used in the roofs of commercial buildings and are designed to open automatically to release smoke and heat in the event of fire within the building. A typical drop-out fire vent has an appearance similar to a skylight and comprises a frame or "curb" that is installed over a vent opening in the roof of the building. A plastic cover or dome is carried by the frame and is made of a plastic material that will soften when exposed to heat, e.g. PVC, acrylic or polycarbonate. Around its perimeter, the cover is coupled to the curb by a retainer frame that is designed to provide weather-tightness, while allowing the dome to pull away and fall into the building as the dome loses structural integrity with increasing temperature.

The domes themselves typically are translucent mouldings so that the vent normally serves as a skylight allowing natural daylight into the building. The dome may be a so-called "QUADRI-DOME" for example as disclosed in U.S. Pat. No. 3,918,226. An existing curb frame design is disclosed in U.S. Pat. No. 4,080,763.

A disadvantage of existing drop-out fire vents is that the precise temperature at which the dome will drop out can vary and typically is quite low compared with the temperature at which a water sprinkler system within the building might be triggered. For example, a fire vent dome may lose structural integrity at a temperature in the region of 160° F. if it is made of PVC, or a temperature as high as 250° F. if it is made of a polycarbonate material. On the other hand, sprinkler systems may require a trigger temperature over 300° F. If the dome drops out before the sprinkler system is triggered, there can be a cooling effect as hot air is vented from the building sufficient to prevent the sprinklers reaching their trigger temperature. In fact, in some jurisdictions, building codes prohibit the use of drop-out fire vents in buildings that are equipped with sprinkler systems, particularly so-called "early suppression—fast response" (ESFR) systems that are designed to dump large volumes of water into the building in a short period of time.

On the other hand, practical experience has been that sprinkler systems sometimes fail to operate correctly. For example, a sprinkler system may be in place in the building for many years before a situation arises in which the sprinkler is required to perform. Over the years, the sprinkler system can deteriorate or sometimes even be shut off for maintenance and never turned back on again, with the result that the sprinkler will not operate when there is a fire. Bearing this in mind, fire departments generally favour installation of vents so that smoke will be removed in the event of a fire, improving visibility for firemen who may have to enter the building. If there are no vents, firemen sometimes will even break holes in the roof of a building to let smoke out.

Another factor of course is that different types of fires emit different amounts of smoke and heat. As such, any fire suppression system should offer a "balanced" approach.

Spring-activated "pop-up" vents are available, although they have their own disadvantages. This type of vent can be designed to open at a fairly precise elevated temperature, but is relatively complex and expensive to manufacture. Also, the vent must be capable of moving to its full open position against the effects of the wind, snow, ice and debris that may have accumulated on the vent over the years. Mechanical spring-driven struts that are used to open the vent are prone to deteriorate with time. Reliability of operation is a concern.

Accordingly, an object of the present invention is to provide a fire vent that address the factors outlined above and that can be used effectively in combination with EFSR and other sprinkler systems.

SUMMARY OF THE INVENTION

According to the present invention, there is provided a drop-out fire vent for a building that includes a frame adapted to be installed in a generally horizontal orientation in association with a vent opening in the building, and a cover for the opening (e.g. a dome) carried by the frame and comprising a material that will lose structural integrity when exposed to the effects of fire within the building and drop into the vent opening under gravity. A trap door is coupled to the frame below the cover for movement between a normal position and a release position. In the normal position, the door extends across the vent opening and the door is adapted to support the cover after it has lost structural integrity and prevent the cover falling through the vent opening into the building, while not significantly shielding the cover from the effects of heat within the building. In the release position, the door allows the cover to fall into the building. Fusible link means maintains the trap door in its normal position. The fusible link means is calibrated to release the trap door at a defined temperature higher than the temperature at which the cover loses structural integrity, permitting the cover to fall into the building.

In other words, the trap door provides a supplementary barrier to opening of the vent until the defined temperature is reached. This means that a particular fire vent can be "set" to open at a selected temperature by appropriate selection of the fusible link means.

In this context, the expression "trap door" is to be interpreted broadly and includes, for example, a hinged door, or a door that will drop away completely when the fusible link means releases. Normally, the "door" itself will not be a solid structure but will have a perforated or screen-like configuration that will allow hot air and smoke to pass through the door so that there is no appreciable shielding effect that could otherwise inhibit softening of the cover material.

It is believed that a preferred form of trap door is a relatively lightweight (e.g. aluminum) frame surrounding a perforated screening material. Preferably, the door is hinged at one side to the frame of the vent and retained at the other side by a single fusible link. A preferred arrangement for the fusible link means will be described later. However, within the broad scope of the invention, several fusible links could be used to hold the trap door to the frame so that the trap door will fall out completely when all of the fusible links have melted.

Also within the scope of the present invention is a trap door and fusible link combination for installation in an existing drop-out fire vent, as a so-called "retrofit".

BRIEF DESCRIPTION OF DRAWINGS

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
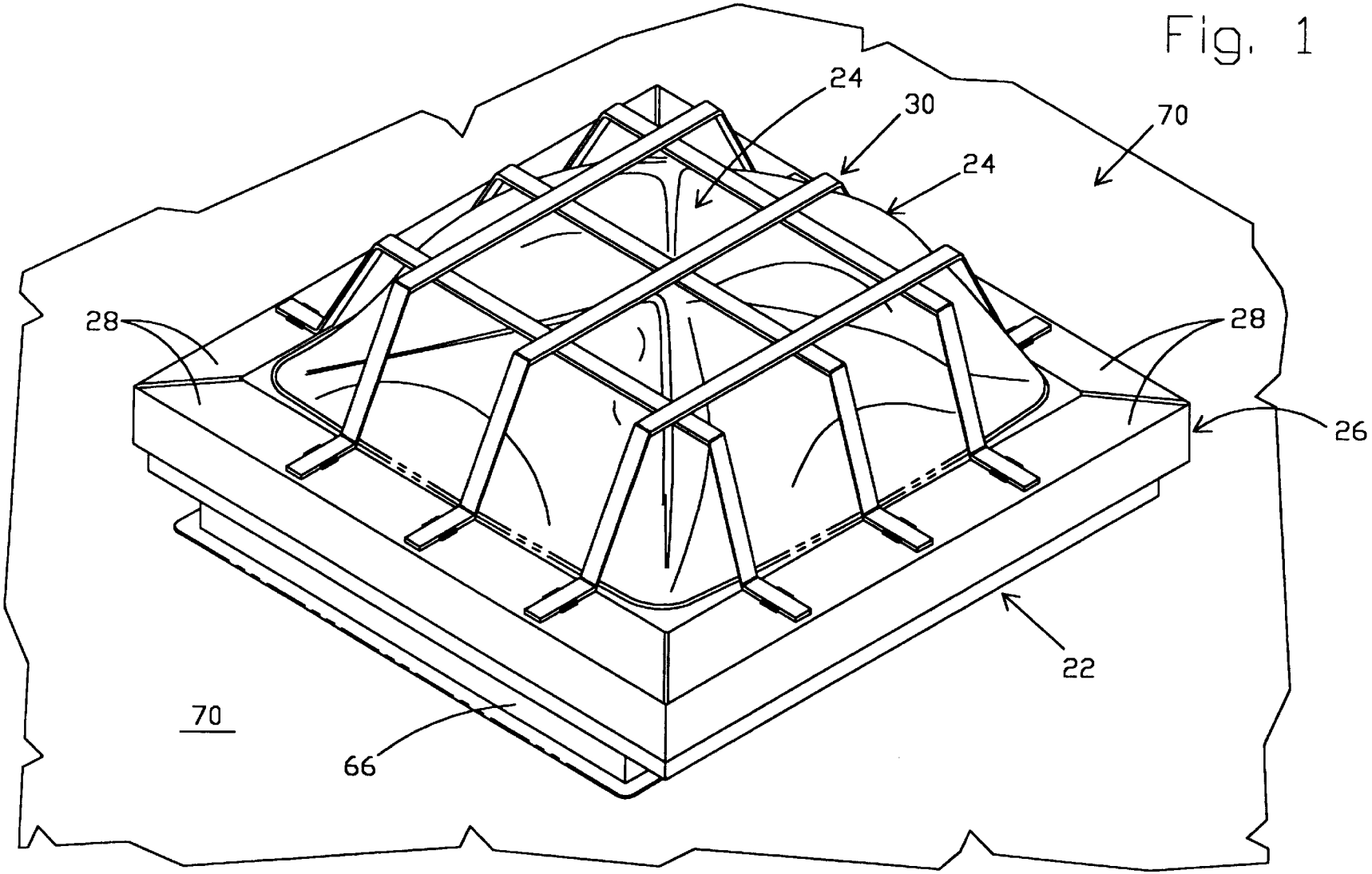
FIG. 1 is a perspective view from above of a drop-out fire vent in accordance with this embodiment of the invention.
Figure 2:
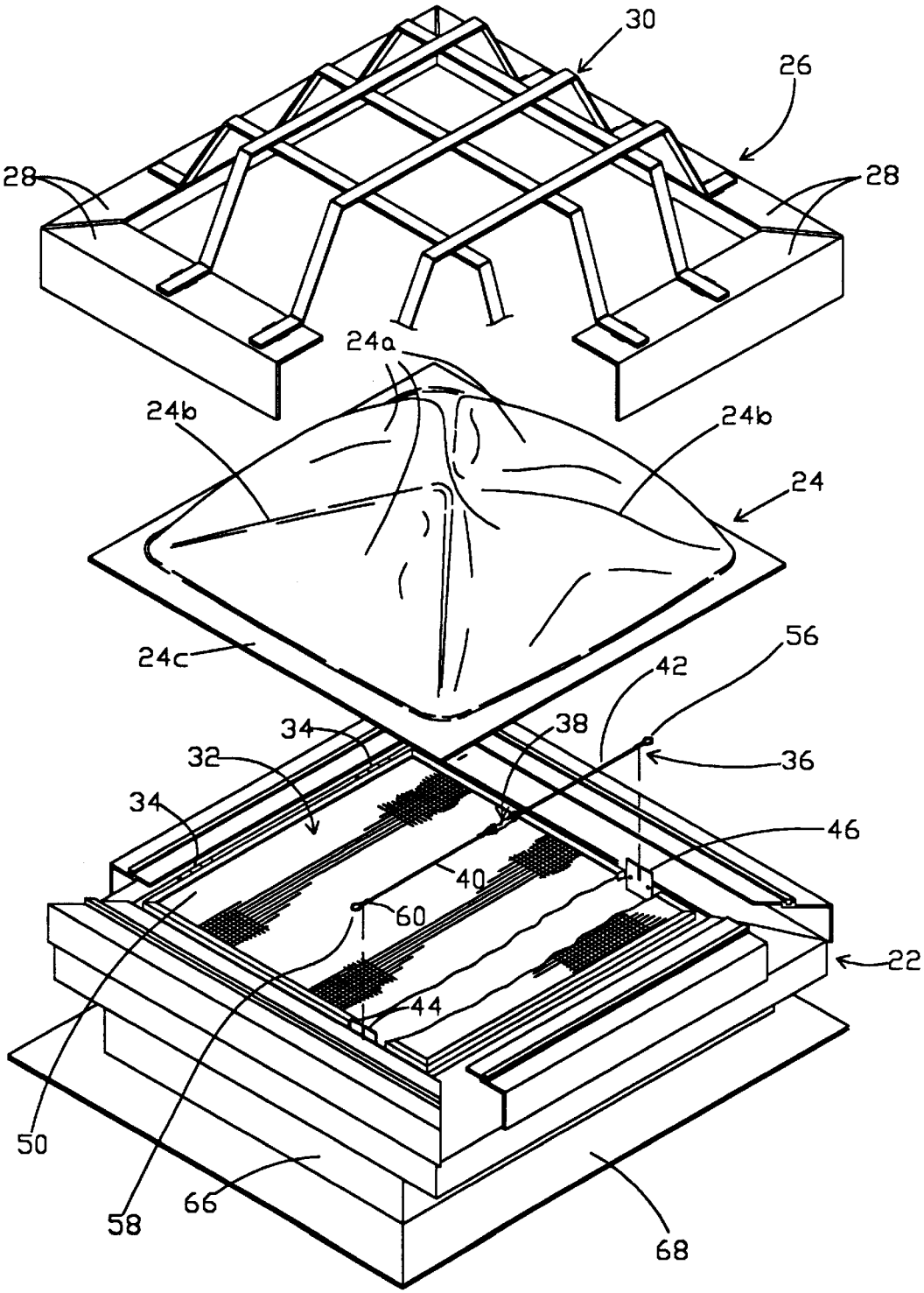
FIG. 2 is an exploded perspective view of the fire vent shown in FIG. 1.
Figure 4:
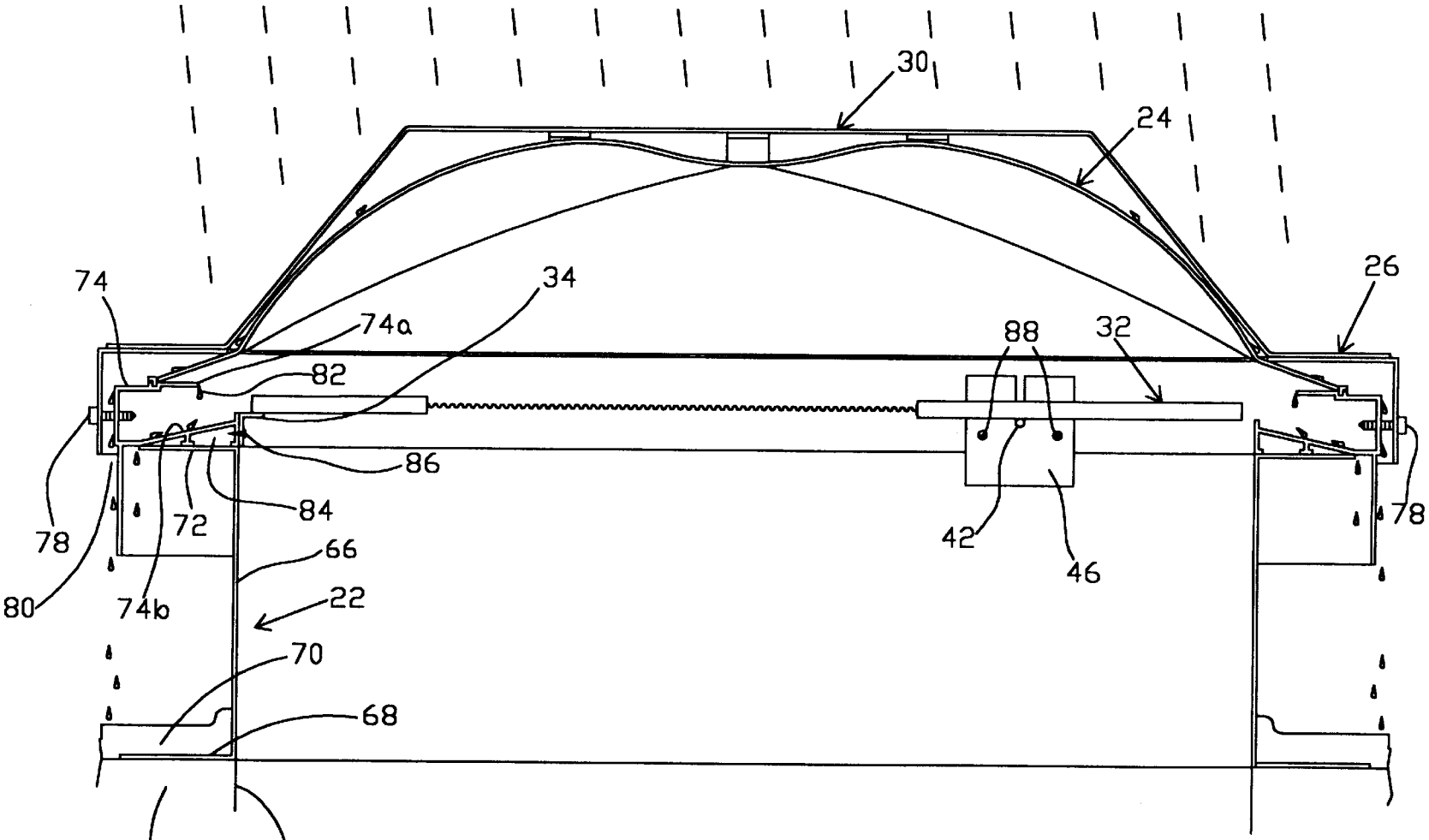
FIG. 4 is a vertical sectional view through the fire vent shown installed in a building.

Referring to FIG. 1, a drop-out fire vent is generally denoted by reference numeral 20 and includes a frame 22 (or "curb") adapted to be installed in a generally horizontal orientation in association with a fire vent opening in a building, and a cover 24 for the opening. FIG. 2 shows the components of the fire vent in exploded positions and illustrates the general overall configuration of the cover 24. In this embodiment, the cover is a so-called QUADI-DOME of the general type disclosed in U.S. Pat. No. 3,918,226. The cover or dome is a plastic moulding, for example of translucent PVC, acrylic or polycarbonate material and is shaped to provide four domed segments 24*a* separated by a generally cross-shaped recess area 24*b* that gives structural strength to the moulding. A flange 24*c* extends around the perimeter of the cover. As best shown in FIG. 4 (to be described) the flange 24*c* is supported on top surfaces of the frame 22 in the assembled vent, and is held in place by a retainer 26 (FIG. 2) that is secured by screws to frame 22 so as to effectively trap the cover 24 on the frame 22. Retainer 26 is an aluminum fabrication comprising a frame of angle section extrusions 28, and a framework 30 of aluminum strips that provides a grill above the cover 24 (in the assembled vent). The grill guards against people on the roof of a building in which the vent is installed, falling through the vent.

Figure 7:
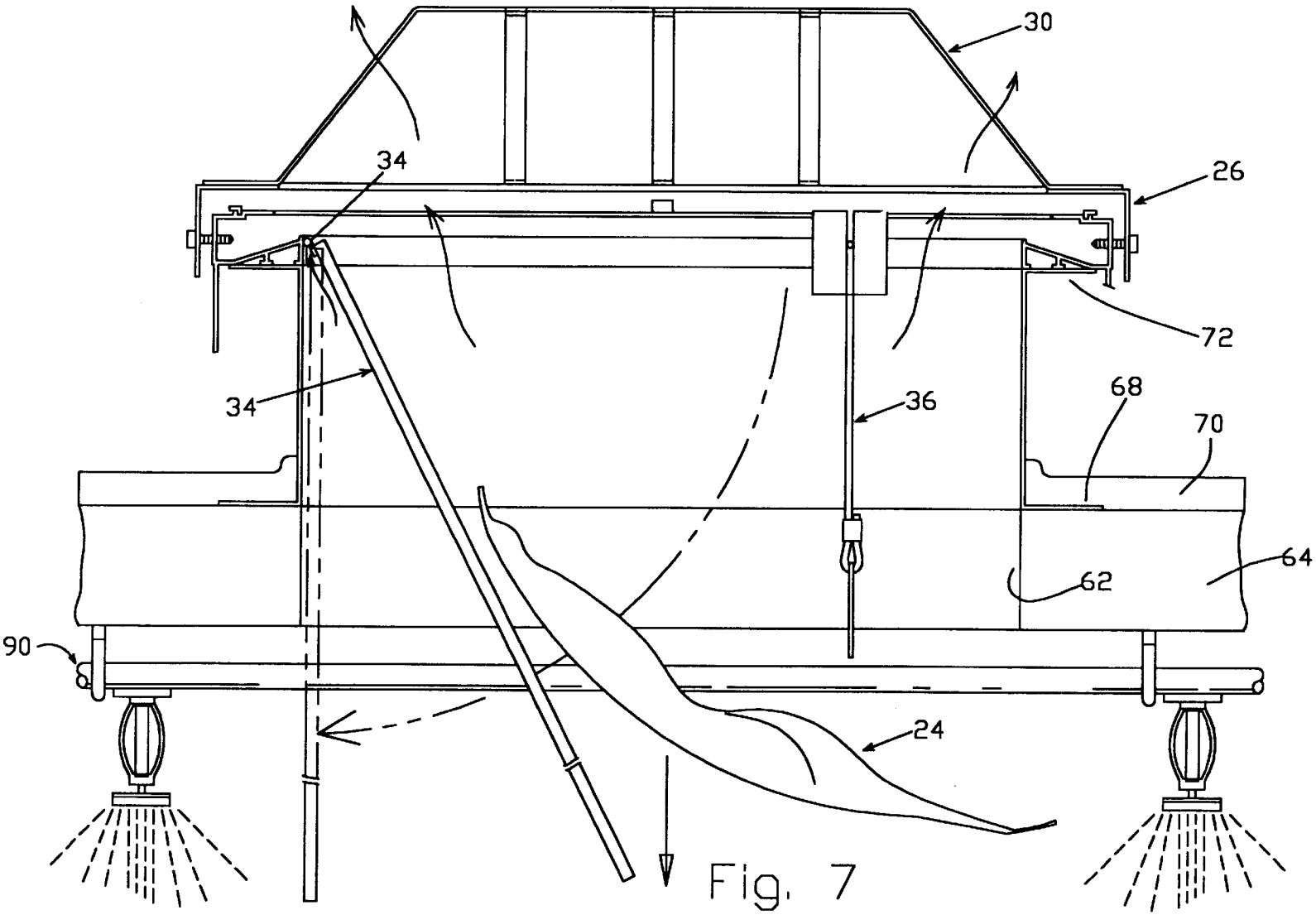

FIG. 2 also shows generally a trap door 32 that is coupled to frame 22 below cover 24 for movement between the normal position in which it is shown in FIG. 2 and a release position as shown in FIG. 7. In the normal position of FIG. 2, the door extends across the opening through frame 22 (corresponding to a vent opening in the roof of the building) and is designed to support the cover 24 after it has lost structural integrity in a fire, preventing the cover falling through the vent opening into the building. At the same time, the trap door does not significantly shield the cover from the effects of heat within the building. FIG. 7 shows the cover falling down into the building when the door is in its release position.

In this embodiment, the trap door 32 is coupled to the frame 22 by a pair of hinges 34 at one side of the trap door. Shown generally in FIG. 2 at 34 is a fusible link assembly 34 that supports the trap door adjacent its end opposite the hinges for maintaining the door in its normal position of use. As will be described in more detail later, the fusible link assembly 36 is designed to release the trap door at a defined temperature higher than a temperature at which the cover has lost is structural integrity, permitting the cover to fall into the building.

Figure 3:
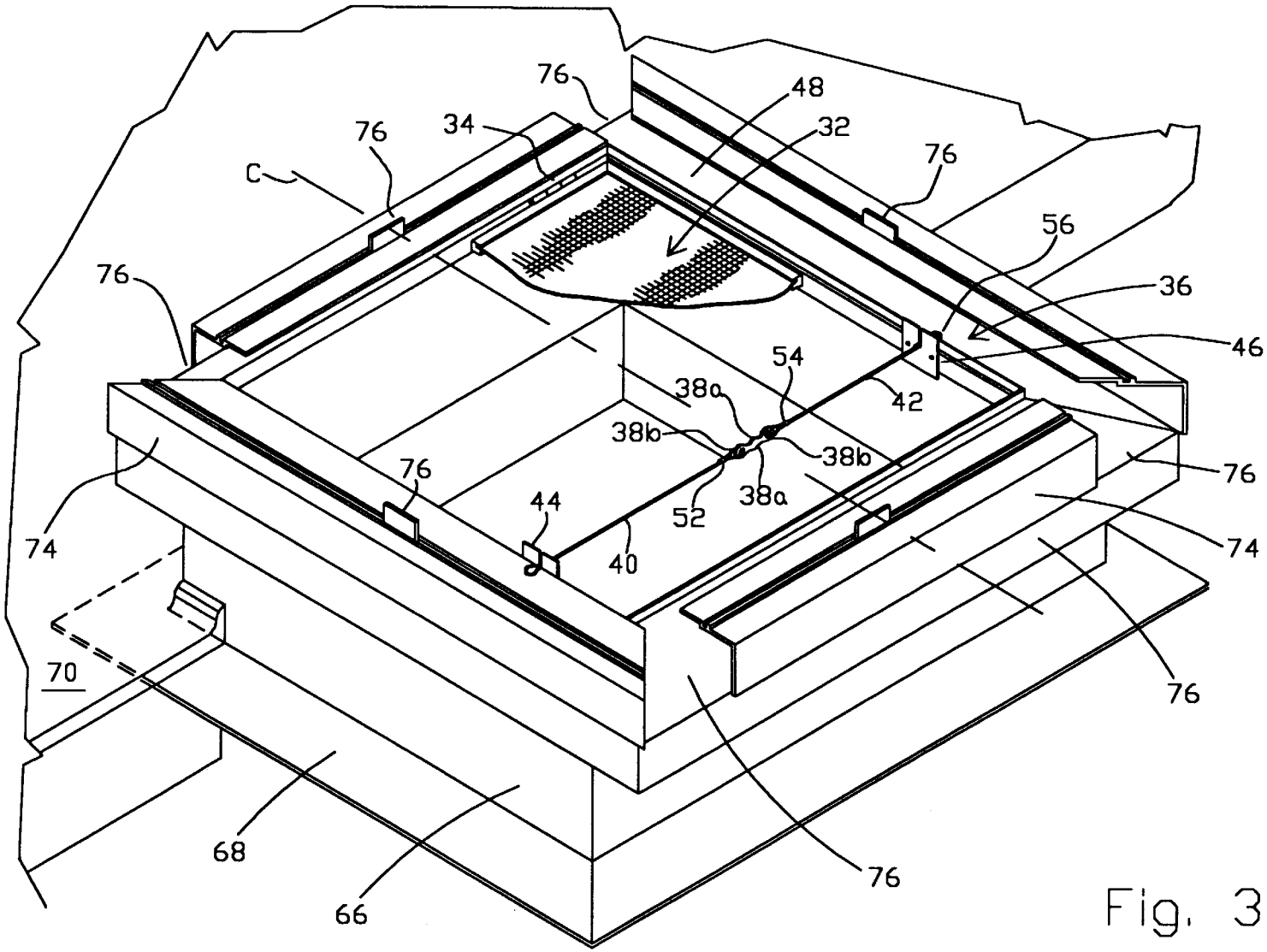
FIG. 3 is a view similar to FIG. 2 but without the cover (dome) or its retainer.

The fusible link assembly 36 is best shown in FIG. 3 and comprises a fusible link 38 coupled between a pair of cables 40, 42 that extend between respective brackets 44, 46 on frame 22, for supporting the trap door 32 from below. FIG. 3 in fact shows only a portion 32 of the trap door but it is evident from views such as FIG. 4 that the fusible link assembly 36 extends below the trap door and the trap door simply rests on the two cables 40, 42 and the fusible link 38.

Reverting to FIGS. 2 and 3, it will be seen that, in this embodiment, the trap door 32 comprises a rectangular frame supporting a rectangular sheet of perforated screening. The frame is made up of four aluminum channels 48 that are assembled with their channels facing inwardly, and embracing marginal portions of a sheet 50 of screening material. Sheet 50 may also be aluminum, for example of the type used for insect screens in windows. It is not essential that the trap door have this form. Requirements for the trap door are that it should be capable of supporting the cover 24 after the cover loses structural integrity, and that the trap door should not open until exposed to a defined temperature. At the same time, the trap door should not significantly shield the cover from the effects from heat within the building.

The brackets 44 and 46 that retain the fusible link assembly 36 are secured by self-tapping screws (not shown) to frame 22. The fusible link 38 itself is of conventional form and comprises a pair of plates 38*a* soldered together face-to-face in a plane that includes the cables 40, 42. Each plate has a ring-shaped distal end portion 38*b*. The respective cables 40, 42 are looped through the openings in the plates and the end portions of the cables secured by crimped sleeves 52, 54 respectively. Outer ends of the respective cables simply extend through vertical open-ended slots in the respective brackets 44, 46 and are provided with swaged end fitments, one of which is shown at 56 in FIG. 3. FIG. 2 shows fitment 56 and its companion 58 at the opposite end of the fusible link assembly. A helical compression spring 60 extends around cable 40 inwardly of end fitment 58. When the fusible link assembly is fitted to the brackets 44, 46, the compression spring 60 is positioned outwardly (i.e. behind) bracket 44 so that, when the fusible link assembly is in place, the cables 40, 42 are maintained under some tension. This represents an optimum operating environment for the fusible link 38 in that the tension creates a shear force on the solder between the two plates 38*a* (the cables are in the plane of the opposed faces of the plates) and helps ensure that the two plates are pulled apart cleanly when the solder between the plates melts.

While the trap door could be held in its normal position by a fusible link coupled directly between the side of the trap door opposite the hinges 34 and the frame 22, it is believed that it may be preferable to position the fusible link closer to the centre of the vent opening in the roof of the building so that the link will be directly in the path of heat coming up through the opening. With this in mind, the two brackets 44, 46 are spaced from the end of frame 22 that is remote from the hinges 34 and the two cables 40, 42 are generally of the same length. As such, the fusible link 38 is positioned on a longitudinal centreline C (FIG. 3) of the frame 22.

The overall size of the trap door itself in relation to the opening through frame 22 is not believed critical, provided that there is adequate support for the cover as it melts, but it is believed desirable to provide for a gap between the trap door and frame 22 through which hot air can flow towards the cover 24.

FIG. 4 shows the fire vent in section, installed over a vent opening 62 in a roof structure 64 of a building. The frame 22 is a fabrication of aluminum extrusions that are fastened together to form a rigid structural unit. The cross-sectional shapes of the extrusions can be seen in FIG. 4. The frame has a sidewall 66 that extends upwardly from an outwardly extending flange 68. The flange 68 can be installed under roof covering material shown at 70, for providing a weather-tight seal.

At the top end of side wall 22 is a further flange 72 that extends outwardly and supports an extrusion 74 that provides an enlarged overhanging rim at the top of frame 22. As best seen in FIG. 3, the extrusions 74 along the four sides of the frame are generally of inwardly facing C-section. Two of those extrusions, at respectively opposite ends of the frame 22, are cut away at 76 to provide drainage openings. As best seen in FIG. 4, a top flange surface 74*a* of extrusion 74 provides a surface that supports the cover 24 through its marginal flange 24*c*. Each extrusion 74 is fitted with a stop 76 for locating the cover (see also FIG. 3).

The shape of extrusion 74 is selected to provide a sloping bottom surface 74*b* as the inside bottom surface of the rim of frame 22. FIG. 4 shows the retainer 26 in place on frame 22. Self-tapping screws 78 are shown securing the retainer to the rim of frame 22. Cover 24 is simply trapped between the retainer 26 and the frame 22, leaving a drainage gap 80 between these parts, but is not physically secured to either part, or caulked. Moisture droplets that impinge on the exterior surface of cover 24 can flow downwardly and outwardly through the gap 80 to the exterior of the vent. Any droplets that may migrate under the flange 24*c* of cover 24 will drip down onto the inclined extrusion surface 74*b* as indicated at 82 and then travel outwardly and downwardly through the gaps 76 at the corners of frame 22 (see FIG. 3). In this way, the vent is rendered weather-tight. At the same time, when the cover 24 loses its structural integrity, it can fall down and pull out from between the retainer 26 and the frame 22.

FIG. 4 also shows that the inclined surface 74*b* of extrusion 74 defines, with flange 72, a generally triangular shaped closed space 84. This space receives self-tapping screws 86 that are used to secure the hinges 34 for the trap door. The screws 86 do not penetrate to the exterior of the vent, so that the weather-tight integrity of the structure is maintained. Screws used to secure the brackets 44, 46 for the fusible link assembly are similarly positioned. Two of those screws (for bracket 46) are indicated at 88 in FIG. 4.

Figure 5:
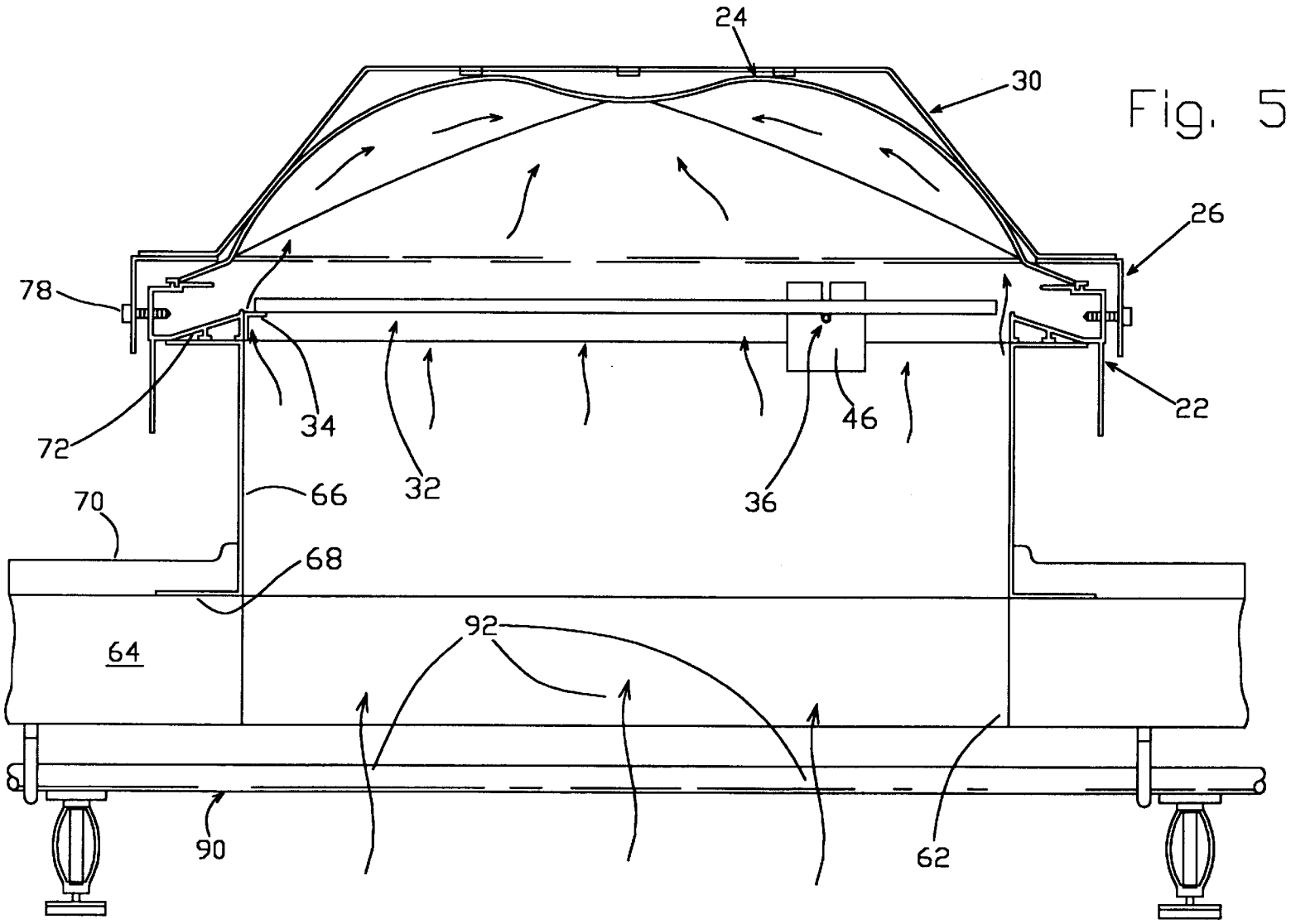
FIG. 5 is a view similar to FIG. 4 illustrating the effect of heat on the cover; and, FIGS. 6 and 7 are views also similar to FIGS. 4 and 5 showing, respectively, the cover supported by the trap door, and the trap door having released the cover to fall into the building.

FIG. 5 is a view similar to FIG. 4 but additionally showing part of a sprinkler system 90 within the building in which the vent is installed. Arrows 92 represent hot air that is rising in the building and through the vent opening 62 as a result of a fire within the building. It can be seen that the hot air is free to pass around and through the trap door 34 and act on the cover 24. In other words, the trap door 34 is essentially transparent to the hot air.

Figure 6:
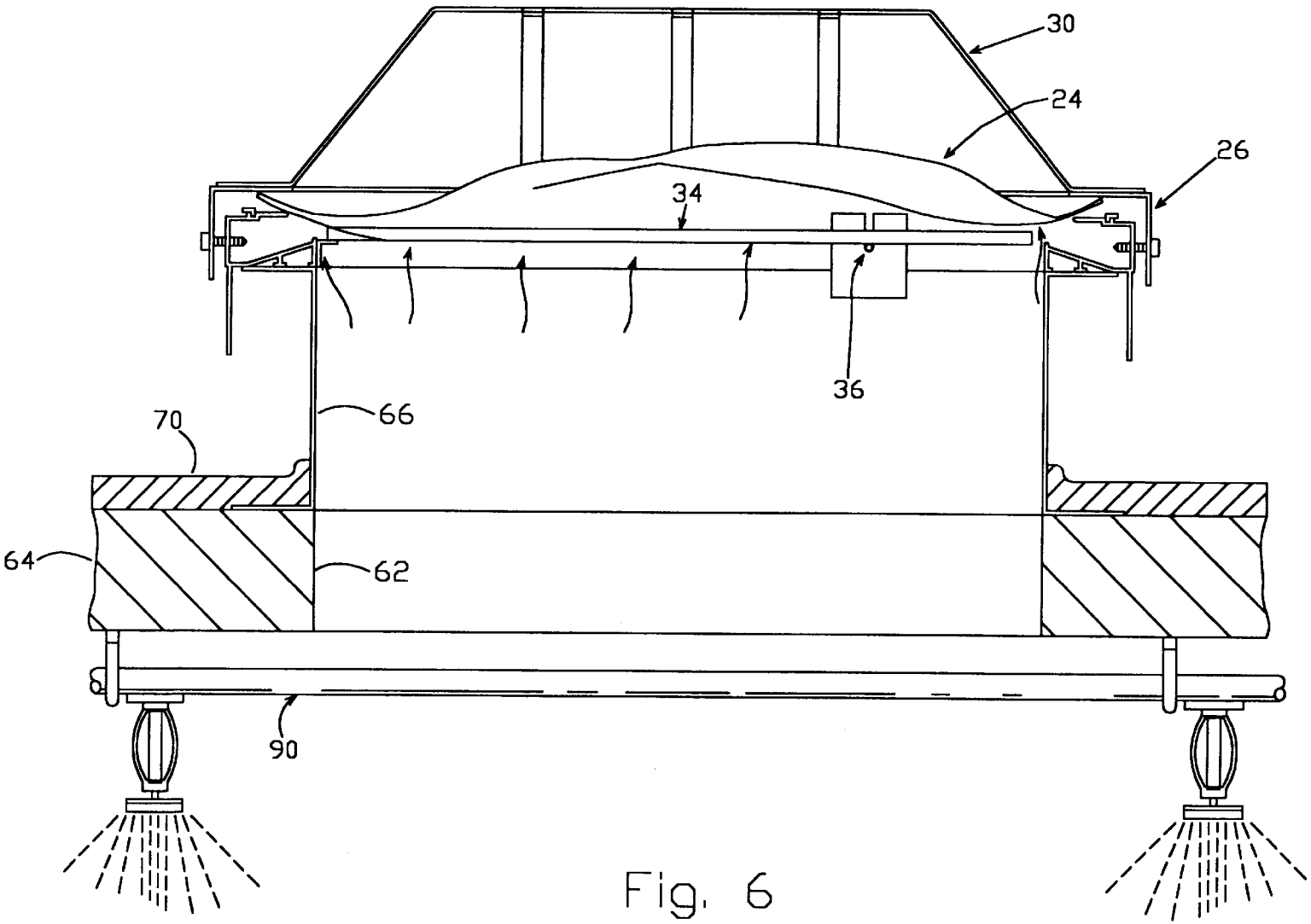

FIG. 6 is a view similar to FIG. 7 but showing the cover 24 as having lost its structural integrity and collapsed onto the trap door 34. However, the vent opening through the roof of the building has not opened because the trap door is holding the collapsed cover across the opening. The sprinklers 90 are shown as having triggered. As the temperature continues to rise and approach the release temperature of the fusible link 38, the solder between the two plates of the fusible link will melt and the plates will separate allowing the two cables 40, 42 to fall down and the trap door 34 to open, as illustrated in FIG. 7. The cover 24 is then free to slide off the trap door and fall away into the building.

In summary, the invention provides a fire vent that can be calibrated (by selection of an appropriate fusible link) to open at any defined temperature above the temperature at which the cover of the vent loses its structural integrity. As indicated previously, the particular temperature at which this happens can vary and depends at least in part on the material from which the cover is made. In any event, the fusible link can be selected to release at whatever temperature is appropriate depending on the particular building in which the vent is installed. For example, the link may be selected to release at 360° F. if the vent is used in combination with an ESFR sprinkler system.

The fire vent of the invention opens under gravity without the need for any auxiliary actuators, such, for example, as spring-driven struts found in the prior art.

Also, while the vent normally will be installed in a flat roof in a building, installation could be in any location or orientation that allows the vent to open under gravity.

As noted previously, while the invention relates primarily to a complete fire vent, it is within the broad scope of the invention to provide a trap door and fusible link assembly combination that can be retrofitted to an existing vent or skylight structure.

It should also be noted that the preceding description relates to a particular preferred embodiment of the invention, and that many modifications are possible within the broad scope of the invention. Some of those modifications have been indicated previously and others will be apparent to a person skilled in the art. Clearly, precise constructional details of the frame of the vent can vary as can the cover and its method of fitment to the frame. As an example, the cover could be a simple flat sheet of plastic, or a single dome. The cover preferably drops out by pulling away from the frame as described herein; however, the vent could open solely due to loss of structural integrity of the cover, e.g. the cover could pull apart.

As noted previously, it is not essential that the trap door be hinged to the frame. Mention has been made of the possibility of using several fusible links to hold the trap door to the frame. Another possibility is to use restraint cables or other devices between the door and the frame.

Multiple trap doors could be used, for example in large openings. Each door could be fitted with fusible link means such as a cable and fusible link.

Finally, it should be noted that a cable and fusible link arrangement generally as shown in the drawings could work on the top of the door assembly by running the cable through eye hooks on top of the door.

I claim:

1. A drop-out fire vent for a building, comprising:

a frame adapted to be installed in a generally horizontal orientation in association with a fire vent opening in a building;

a cover for said opening, carried by the frame and comprising a material that will lose structural integrity when exposed to the effects of fire within the building, and drop out under gravity;

a trap door coupled to the frame below the cover for movement between: (a) a normal position in which the door extends across said vent opening, the door being adapted to support the cover after it has lose structural integrity and prevent the cover falling through the vent opening into the building, while not significantly shielding the cover from the effects of heat within the building, and: (b) a release position in which the door allows the cover to fall into the building; and, fusible link means between the trap door and the frame for maintaining the trap door in its said normal position and calibrated so release the trap door at a defined temperature higher than a temperature at which the cover loses structural integrity and permit the cover to fall out.

2. A fire vent as claimed in claim 1, wherein said trap door includes a perforated material for permitting passage of air and smoke through the trap door.

3. A fire vent as claimed in claim 2, wherein said frame is rectangular and said trap door has a rectangular shape designed to fit within the frame while leaving a gap around the perimeter of the trap door and between the trap door and the frame.

4. A fire vent as claimed in claim 1, wherein the trap door and frame each have a rectangular shape and the trap door is disposed within the frame, the trap door having a first end and being coupled to the frame by hinge means for permitting movement of the trap door between its said normal position and its said release position.

5. A fire vent as claimed in claim 4, wherein the trap door has a second end remote from the first end, and wherein the fusible link means comprises a pair of cables, and a fusible link connected between the cables, the fusible link means extending across the frame generally parallel to the first and second ends of the trap door and below the trap door so as to support the trap door from below.

6. A fire vent as claimed in claim 5, wherein the fusible link comprises a pair of plates soldered together in face-to-face relationship in a plane containing said cables, the fusible link means further comprising spring means maintaining the cables under tension so as to provide a shear force between the plates for assuring clean separation thereof when the fusible link releases.

7. A fire vent as claimed in claim 5, wherein the cables extend between respective brackets at opposite sides of the frame and are engaged in respective open-ended slots in the brackets, the fusible link means being spaced significantly from said second end of the trap door, while maintaining support of the trap door, the cables being of substantially equal length, whereby the fusible link is positioned generally on a longitudinal centreline of the frame.

8. A fire vent as claimed in claim 7, wherein said frame comprises a fabrication of extrusions that include closed wall sections for receiving screws for securing to said frame the hinge means and the brackets for the fusible link means.

9. A fire vent as claimed in claim 1, for use in combination with an early suppression fast response sprinkler system, when the fusible link is selected to have a release temperature of 360° F.

10. A fire vent as claimed in claim 1, wherein said cover is a domed structure of a translucent plastic material.

11. A fire vent as claimed in claim 1, wherein said cover is supported around its perimeter on said frame, and wherein the fire vent further comprises a cover retainer that co-operates with the frame to receive the cover in weather-tight fashion, while allowing the cover to pull out after the cover has lost its structural integrity.

12. For use in a drop-out fire vent for a building comprising a frame adapted to be installed in a generally horizontal orientation in association with a fire vent opening in the building, and a cover for said opening carried by the frame and comprising a material that will lose structural integrity when exposed to the effects of fire within the building and drop out under gravity;

the combination of:

a trap door adapted to be coupled to the frame below the cover for movement between: (a) a normal position in which the door extends across the vent opening, the door being adapted to support the cover after it has lost structural integrity in use and prevent the cover falling through the vent opening into the building, while not significantly shielding the cover from the effects of heat within the building, and: (b) a release position in which the door allows the cover to fall into the building; and, fusible link means adapted to be installed between the trap door and the frame of the fire vent for maintaining the trap door in its said normal position, the fusible link means being calibrated to release the trap door at a defined temperature higher than a temperature at which the cover of the fire vent loses structural integrity and permit the cover to fall out.

* * * * *